US007303183B2

(12) United States Patent
Winter

(10) Patent No.: US 7,303,183 B2
(45) Date of Patent: Dec. 4, 2007

(54) SAFETY BRAKE MECHANISM FOR A WINDING DRUM AND METHOD FOR GRINDING A SAFETY BRAKE

(75) Inventor: Klaus-Jürgen Winter, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 329 days.

(21) Appl. No.: 11/217,880

(22) Filed: Sep. 1, 2005

(65) Prior Publication Data

US 2006/0169964 A1 Aug. 3, 2006

(30) Foreign Application Priority Data

Sep. 9, 2004 (DE) ..... 10 2004 043 592

(51) Int. Cl.
*B66D 5/08* (2006.01)

(52) U.S. Cl. ..... 254/378; 254/376

(58) Field of Classification Search ..... 254/267, 254/274, 375, 376, 377, 378
See application file for complete search history.

(56) References Cited

U.S. PATENT DOCUMENTS 4,489,919 A * 12/1984 Ostrobrod ..... 254/346
4,493,479 A * 1/1985 Clark ..... 254/274
4,520,998 A * 6/1985 Flaig ..... 254/267
5,201,821 A * 4/1993 Ericson et al. ..... 254/375
5,344,121 A * 9/1994 Baziuk ..... 254/358
5,458,318 A * 10/1995 Jussila ..... 254/267
5,664,766 A * 9/1997 Baziuk ..... 254/375
5,671,912 A * 9/1997 Langford et al. ..... 254/267
5,860,635 A * 1/1999 Morfitt et al. ..... 254/377
6,695,292 B2 * 2/2004 Nam ..... 254/267
7,080,825 B1 * 7/2006 George et al. ..... 254/267

FOREIGN PATENT DOCUMENTS

DE 19633836 C1 3/1998

* cited by examiner

*Primary Examiner*—Emmanuel M Marcelo
(74) *Attorney, Agent, or Firm*—Van Dyke, Gardner, Linn & Burkhart, LLP

(57) ABSTRACT

The invention concerns a safety brake mechanism for the winding drum (8) of a hoisting machine that can be driven via a motor (4) with lifting gearbox (3), which is substantially braked to a standstill without jerking when the lowering speed is excessive by a brake ring (12) that revolves concentrically with the winding drum (8) and is frictionally joined to the latter, when the brake ring (12) lying against a cylindrical brake surface (23) of the hoisting machine is locked. In order to allow for the grinding and adjusting of the necessary braking moment in the disconnected condition of the winding drum prior to the assembly of the complete lifting mechanism with low expenditure of material and cost, the brake surface (23) for the brake ring (12) may be provided on its outer circumference with a rigid coupling (10) that concentrically connects a lifting gearbox (3) and a winding drum (8), to which the lifting gearbox (3) and winding drum (8) are removably connected.

21 Claims, 2 Drawing Sheets

SAFETY BRAKE MECHANISM FOR A WINDING DRUM AND METHOD FOR GRINDING A SAFETY BRAKE

BACKGROUND OF THE INVENTION

The invention concerns a safety brake mechanism of a driven winding drum of a hoisting machine. The invention is particularly useful for braking the winding drum to a standstill without jerking, when the lowering speed is excessive, by a brake ring. The brake ring revolves concentrically with the winding drum and is frictionally joined to the latter, as soon as the brake ring lying against a cylindrical brake surface of the hoisting machine is locked. The invention also concerns a method for grinding the safety brake.

Safety brake mechanisms are familiar and are used, for example, as a safety mechanism in the form of a second brake for cable winches, sliding door drive systems, or similar winding mechanisms. Such winding mechanisms require, besides the usual service brake, a safety brake mechanism working independently of the motor brake generally arranged on the motor. Such a safety brake mechanism, upon failure of the lifting drive, for example, after gear breakage in the lifting gearbox, is intended to safely prevent the load from dropping, or terminate its unintentional descent after a relatively short drop.

One safety brake of the above-described kind is known, for example, from the German Patent DE 31 37 523 C2. It is used to safeguard a hoisting machine and is supposed to brake the cable drum without jerking when the lowering speed is excessive. For this purpose, a cylindrical brake surface is formed at the periphery of the cable drum in the region of one of its two end faces and this is surrounded by a brake ring. The brake ring is formed from individual segments and provided with a brake lining on its inner circumference, which can be pressed against the brake surface while being adjustable in its contact pressure. In the operating state of the hoisting mechanism, the brake ring is frictionally entrained by the brake lining and revolves along with the cable drum of the lifting mechanism. On its outer circumference, the brake ring is configured as a ratchet, whose teeth can engage with an outside-activated pawl, attached to the frame of the safety mechanism, which instantly locks the brake ring when there is trouble with the lifting mechanism. Since the brake ring lies frictionally against the brake surface by its brake lining, when the brake ring is locked abruptly by means of the pawl, the brake lining of the locked brake ring at first slips somewhat on the brake surface until the lifting drum is brought to a standstill. In any case, a gentle braking of the cable drum requires a properly adjusted contact pressure of the brake lining against the brake surface.

In order to properly adjust the contact pressure to the required braking moment for the braking of the cable drum, it is customary to grind the brake lining under excess load. For this, the lifting mechanism is at first completely assembled, so that the operating conditions of the subsequent working under load can be created. The actual grinding process is very time consuming, because several braking processes have to be carried out under load and, after each braking process, the tube of the winding drum has to cool down to ambient temperature. As a result of this multiple repetitive process, the production flow of the lifting mechanisms is greatly disrupted, and the time it takes the lifting mechanism to move through the final assembly becomes substantially longer, as compared to the assembly of a lifting mechanism without such an additional safety brake.

An improved solution as compared to the aforesaid prior art is described in the German Patent DE 196 33 836 C1. In this solution, the drum for the cable can be connected to the output shaft of the hoisting transmission. The output shaft is provided with a neck piece, which serves as a braking surface for the brake shoes of the safety brake. In this solution as well, blocking means are provided for halting the brake shoes, which are mounted on a brake ring, being secured either directly or indirectly to the frame, as described at the outset.

Since the brake surface for the brake shoes of the safety brake is joined directly as a structural unit to the output shaft of the lifting gearbox, the safety brake after being assembled can be adjusted to the lifting gearbox and tested without having to outfit the lifting mechanism completely with the cable drum.

Although this solution also represents an improvement over the prior art described at the outset, nevertheless it comes with the drawback that the lifting gearbox is required for the grinding and adjusting of the safety brake, and this is under heavy load, since the braking moment which is produced for the grinding normally lies far above the loading moment of the lifting gearbox. Another drawback of the known solution is that the take-off shaft of the lifting gearbox, which is configured as a single piece, needs to have a very large diameter at its end face in order to accommodate the cable drum. Since the take-off shaft of the lifting gearbox needs to be made of high-strength material, this solution is very cost intensive.

SUMMARY OF THE INVENTION

Based on the above-described prior art, the basic problem addressed by the invention is to configure a generic safety brake mechanism so that the grinding and adjusting of the braking moment, needed to disengage the winding drum, can be separated from the rest of the production process for the lifting mechanism. Also, the grinding and adjusting of the braking moment may be done prior to the assembly of the complete lifting mechanism with little outlay of material and costs.

To solve this problem, the invention proposes that the braking surface for the brake ring be provided on its outer circumference with a rigid coupling that concentrically connects a take-off shaft of a lifting gearbox and a winding drum, to which the take-off shaft and winding drum can be removably connected. Since the brake surface in the invention, contrary to the aforementioned prior art solutions, is arranged on a totally separate structural part that can be removed between the take-off shaft and winding drum, it becomes possible to carry out the grinding process independently of the winding drum and also of the take-off shaft. This can be performed prior to the final assembly of the take-off shaft, so that there is no additional loading of the lifting gearbox. The production flow and the assembly are not hindered by the adjustment and testing processes and the coupling can be made more economically than a costly drive shaft as in the prior art.

As a result of its design construction, a safety brake, provided according to an aspect of the invention, enables a working procedure for grinding the brake ring, in which the coupling together with the brake ring set in place and about to be ground is tested in a device which simulates the lifting mechanism and the required frictional moment is adjusted before the safety brake mechanism is assembled.

In one embodiment of the invention, the coupling is configured cylindrical at least in the region of the brake surface and it is joined at one end via a concentric hub to the take-off shaft of the lifting gearbox and at the other end to the winding drum at its outer circumference adjoining the brake surface. Being a simple structural part that is placed between the lifting gearbox and the winding drum, the coupling can be prepared and positioned regardless of different transmission ratios of the lifting gearbox. Also, regardless of the design of the winding drum, the grinding and positioning can be done with cost savings in specially created devices, and in economically effective lot sizes and regardless of the particular job order status for the overall lifting mechanism. The couplings prepared in this way with a brake mechanism can be fabricated, placed in storage or shipped out independently of the other parts of the lifting mechanism.

In another embodiment of the invention, the hub and the output shaft of the lifting gearbox are joined by means of corresponding rotation drivers. In this way, the coupling for transmission of the drive torque can be easily mounted on the take-off shaft after the brake ring has been ground onto the brake surface of the coupling outside of the lifting mechanism and adjusted to the proper braking moment.

The rotation driver may be configured as a key or spline shaft connection. With such shaft-hub connections, as is known, torques can be transmitted very well in alternating directions.

In order to center and securely prop up the coupling carrying the winding drum on its outer circumference, according to another aspect of the invention, a region of the hub adjoining the rotation driver may be equipped with a centering piece which is supported against the take-off shaft of the lifting gearbox. The take-off shaft is provided accordingly with a shaft collar, which carries the centering piece of the hub. In this way, not only is a centered rotation of the coupling achieved, but also a large amount of the weight of the coupling and the winding drum is transferred to the stable take-off shaft of the lifting gearbox.

The coupling may be configured in the shape of a pot, according to another feature of the invention, in a configuration that it encloses the take-off shaft of the lifting gearbox with a radial spacing, while at least the centering piece of the hub that is braced on the take-off shaft extends into the winding drum. In this manner, the load of the winding drum itself is transferred to the output shaft of the lifting gearbox near its center of gravity.

The brake ring may be placed on the region of the outer circumference of the coupling that is away from the winding drum and can be locked by means of the locking device secured on the housing of the safety brake mechanism. The locking device can have any desired configuration, and a pawl of the type known in the prior art is used. The pawl engages with a ratchet configured with toothing on the outer circumference of the brake ring.

To secure the winding drum onto the coupling of the invention, recesses facing each other may be distributed about the circumference of the winding drum and the coupling, and coupling elements can be inserted in the recesses in order to join the winding drum to the coupling.

The benefits of the invention are clear. The production flow and the assembly of the lifting mechanism are no longer impeded by the positioning and grinding of the safety brake on the separate structural part of the coupling. Furthermore, the structural separation of the brake surface, both from the winding drum and also from the transmission take-off shaft, enables a universal use of the couplings accommodating the brake surface in the most diverse of brake mechanisms. Both the driving and the take-off end of the couplings can be individually adapted to the particular driving situation of lifting gearbox and winding drum. Couplings with brake mechanisms can be stocked up in inventory.

These and other objects, advantages and features of this invention will become apparent upon review of the following specification in conjunction with the drawings.

DESCRIPTION OF THE PREFERRED EMBODIMENT

Figure 1:
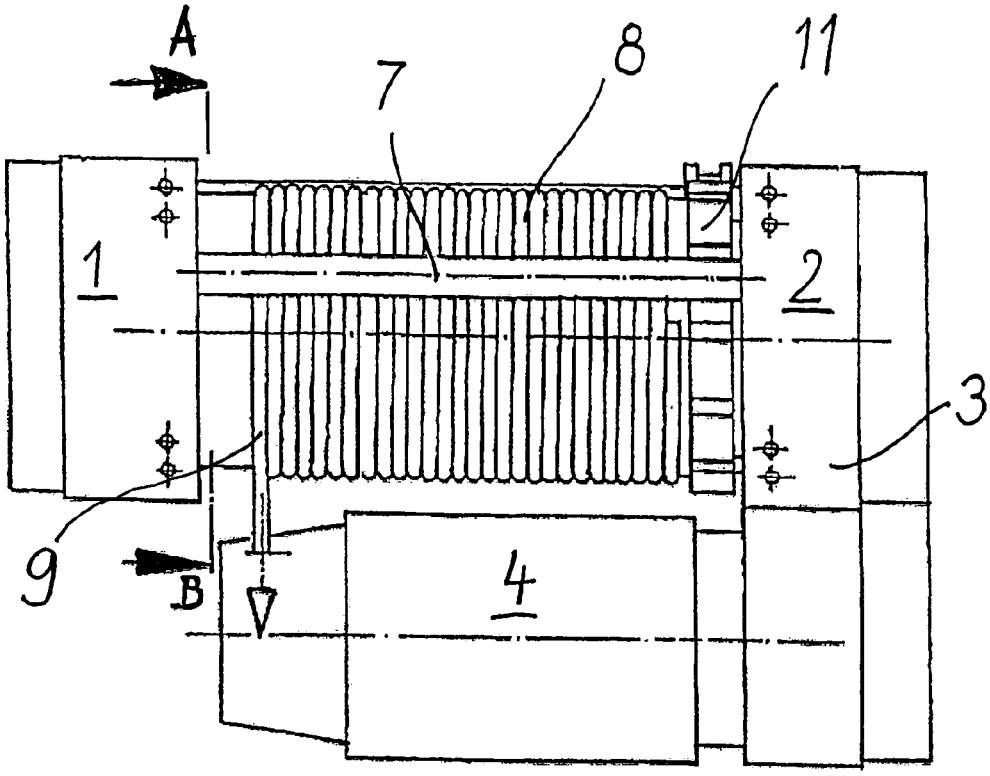
FIG. 1 is an overall view of a lifting mechanism according to the invention in schematic representation.

Referring now specifically to the drawings, and the illustrative embodiments depicted therein, FIG. 1 shows in schematic representation a lifting mechanism, in which the safety brake of the invention has been installed. The lifting mechanism, in simplified manner, includes two frame pieces 1 and 2, which are joined together by means of connection rods 5, 6 and 7, of which only the connection rod 7 is illustrated in FIG. 1. The frame pieces 1 and 2 carry the winding drum 8, which can raise and lower loads via the wire cable 9. The rotation drive of the winding drum 8 occurs via a motor 4, which drives the input shaft (not shown here) of the lifting gearbox 3, which is installed in the frame piece 2. Between the lifting gearbox 3 and the winding drum 8 one can recognize the brake mechanism 11, which is propped against the two connection rods 5 and 6 and is thus indirectly joined to the stationary frame piece 2.

The brake mechanism 11 itself consists, as will be described further with respect to FIG. 2, of the brake ring 12 with the brake lining 24, which can be pressed against a brake surface 23. Furthermore, the brake mechanism 11 includes a device for locking the brake ring 12.

Figure 2:
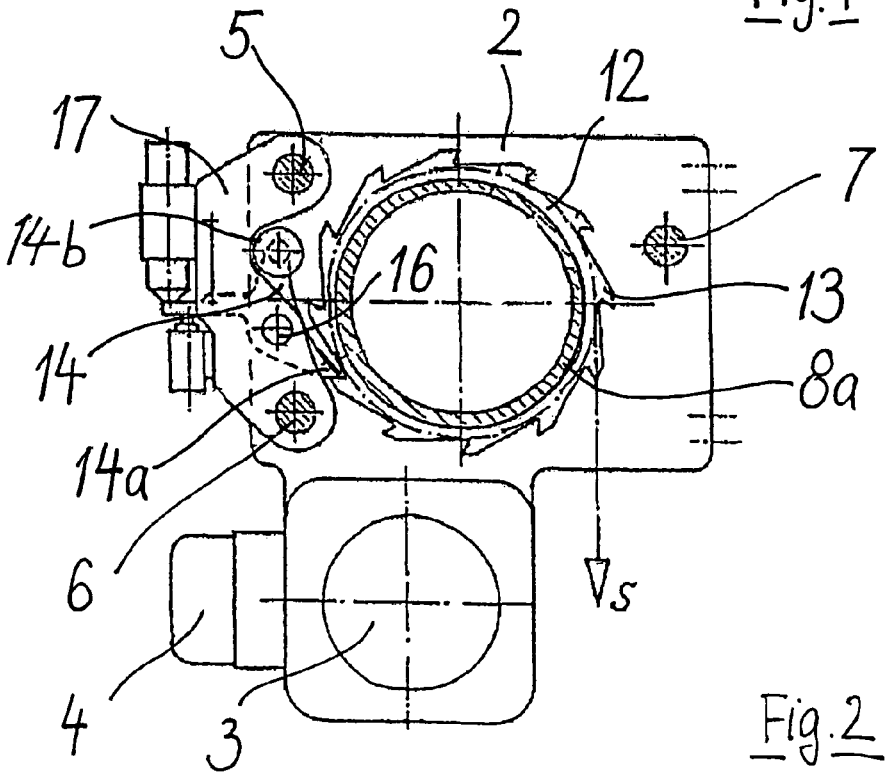
FIG. 2 is a section through the lifting mechanism of FIG. 1 taken along the line A-B.

FIG. 2 shows a cross section through the lifting mechanism along line A-B in FIG. 1, so that the details of the safety brake mechanism can be recognized. On the tube 8*a* of the winding drum 8, shown in cross section, one can notice the brake ring 12, which is provided on its circumference with uniformly distributed teeth of a ratchet 13, which engage with the pawl 14 as a locking device, so that the brake ring 12 can be fastened with respect to the frame piece 2. In the drawing, the pawl 14 is shown in its engaged position, when its tip 14*a* locks one of the teeth of the ratchet 13 of the brake ring 12 and thereby prevents the winding drum 8 from turning.

As can be seen in FIG. 2, the pawl 14 is mounted so that it can swivel on the bolt 16 inside the two bearing plates 17, which in turn are fastened to the connecting rods 5 and 6. The pawl 14 is held spring-tensioned in a position during the operation of the lifting mechanism so that the tip 14*a* is positioned outside the envelope circle of the brake ring 12 and remains so for as long as the maximum permissible operating speed of the winding drum 8 is not exceeded. In order for the pawl 14 to move with its tip 14*a* into the ratchet 13 in event of a failure situation, it is configured as a double-arm lever, at whose end away from the tip 14*a* is mounted a roller 14*b*, which rolls along a cam disk (not recognizable in the drawing). The cam disk is shaped such that, in event of a failure at the lifting gearbox, and when a considerable increase in the turning speed of the winding drum 8 beyond a permissible value indicates that the load will be dropped, the roller 14*b* is forced upward, so that the pawl 14 swivels about the bolt 16 and is forced with its tip 14*a* behind a tooth of the ratchet 13. In this way, the brake ring 12 is locked at once. This process, with additional details on the function and construction of the brake mechanism 11, is described in the German Patent DE 31 37 523 C2, which is hereby incorporated herein by reference.

Since an abrupt dropping of the pawl 14 into a tooth of the ratchet 13 locks the brake ring 13 at once, with no delay, the lifting mechanism and/or the load may suffer damage unless steps are taken to brake the winding drum 8 with the load free of jolting. To accomplish this, the above-described brake ring 12 is installed with a frictional connection between lifting gearbox 3 and winding drum 8 (FIG. 3).

A gentle, but nevertheless as fast as possible a braking of the winding drum is achieved by the brake lining 24 of the brake ring 12 being pressed against the brake surface 23 with precisely defined contact pressure (braking force), in order to make sure that the braking delay is large enough to bring the winding drum to a halt within a short travel distance. This is achieved, as already emphasized, by the brake ring 12 precisely ground, tested, and prepared in relation to the brake surface 23 before the lifting mechanism is placed in service.

Figure 3:
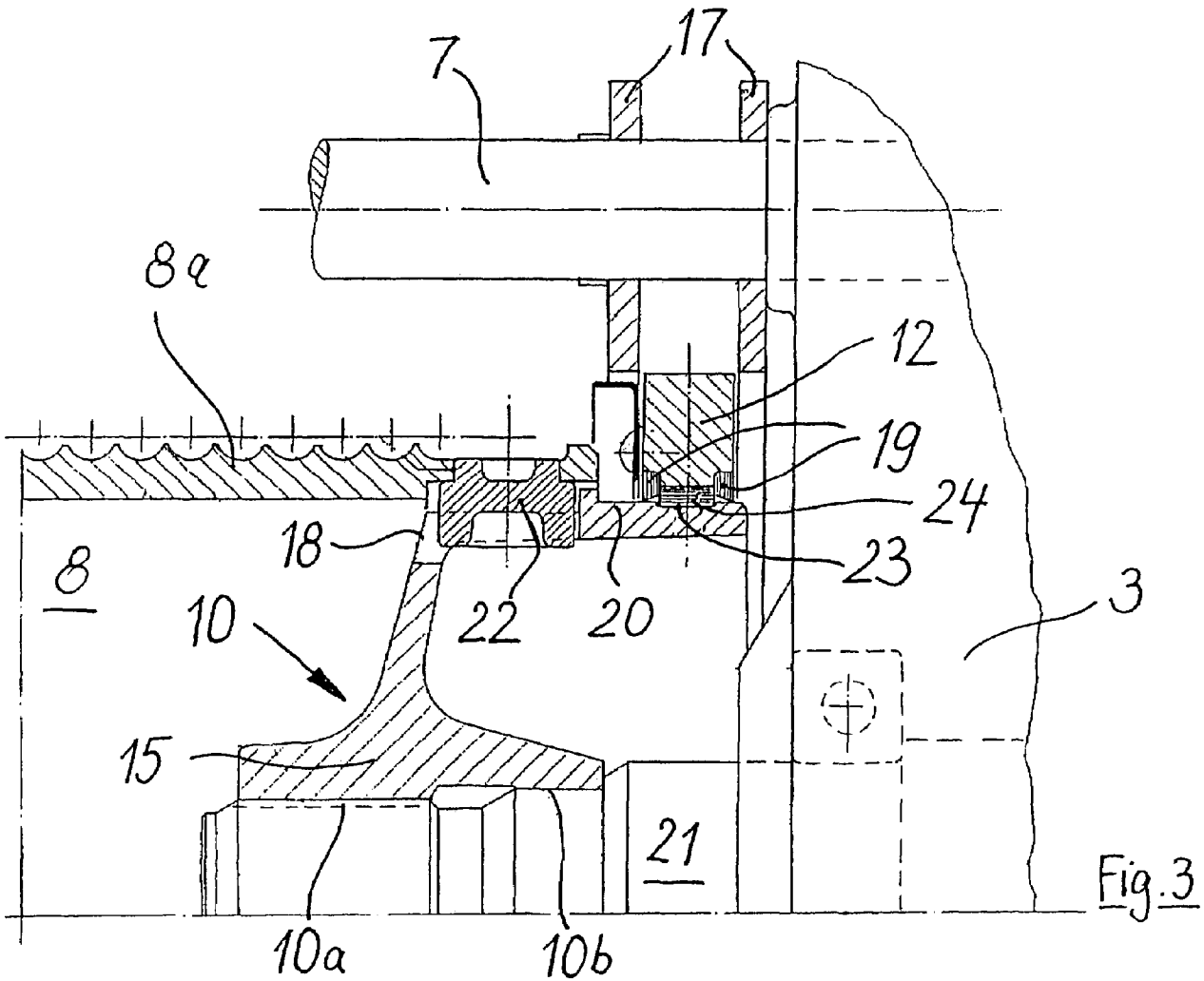
FIG. 3 is an enlarged partial section illustrating a coupling according to the invention.

A rigid coupling 10 is provided between the lifting gearbox 3 and the winding drum 8, which shall be described more closely hereafter by means of FIG. 3.

FIG. 3 shows a partial section of the lifting mechanism in an enlarged view. The lifting gearbox, which is arranged in the frame piece 2, is referenced at 3. All that is represented of gearbox 3 is the take-off shaft 21 on which the rigid coupling 10 is placed and secured by its hub 15 which has a rotation driver 10*a*. Driver 10*a* is illustrated in the form of a key meshing. By means of the rotation driver 10*a*, the coupling 10 is driven and carried along as soon as the take-off shaft 21 of the lifting gearbox 3 is caused to turn by the motor 4 (FIG. 1).

As can be recognized at 10*b*, a centering seat has been machined on the take-off shaft 21 to the side of the rotation driver 10*a*, where an enlarged inner circumference region of the hub 15 of the coupling 10 is supported, stabilizing the latter. The outer circumference 20 of the coupling 10 extends in the manner of a bell in the direction of the gearbox 3 across the take-off shaft 21 and concentrically encloses the latter. In this region, on the outer circumference 20 of the coupling 10, is formed the brake surface 23, likewise concentric to the take-off shaft 23 and enclosed in familiar fashion by the brake ring 12. The brake ring 12 is provided on its inner circumference with the brake lining 24, which is pressed with adjustable contact pressure against the brake surface 23 formed on the coupling 10. So that no dirt or moisture can get in between brake surface 23 and brake lining 24, gaskets 19 are provided at either side of the brake surface 23 between brake ring 12 and coupling 10 to seal off the gap between the structural parts.

In the region of the outer circumference 20 of the coupling 10 that is away from the lifting gearbox 3, the tube 8*a* of the winding drum 8 is secured, likewise concentric with the take-off shaft 21. For this purpose, the drum tube 8*a* and the coupling 10 are provided with opposite openings 18, through which coupling elements 22 extend, joining together the coupling 10 and the winding drum 8.

Since the coupling 10 is detachably connected to both the take-off shaft 21 of the lifting gearbox 3 (via the rotation driver 10*a*) and to the winding drum 8 (via the coupling elements 22), it can be taken off from the take-off shaft 21, and the winding drum 8 can be taken off from the coupling 10.

Brake surface 23 is formed neither on the winding drum 10 itself, nor provided on fixed parts of the lifting gearbox 3. Rather, brake surface 23 is arranged on the coupling 10 which can be detached from both the winding drum and the lifting gearbox. Brake ring 12 can also be used as a separate structural part. This makes possible the grinding of the brake ring 12, set in place, prior to the assembly of the complete lifting mechanism. For this purpose, for example, the coupling 10 can be pushed with the rotation driver 10*a* provided in its hub 15 onto a corresponding four-key shaft of a specially constructed jig, in which the failure of the lifting mechanism can be simulated. In this way, the brake ring 12 can be adjusted and adapted without hindering the manufacture of the lifting mechanism and without damaging the lifting gearbox by excessive loading in the trial operation. As soon as the brake ring 12 is seated on the brake surface 23 of the coupling 10 with the optimally adjusted contact pressure, the coupling 10 together with the brake ring 12 can be installed directly in the lifting mechanism and thus be joined, ready to operate, with the take-off shaft 21 of the lifting gearbox 3 and with the winding drum 8, or placed in stock in the warehouse until needed for use.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A safety brake mechanism of a driven winding drum of a hoisting machine, said hoisting machine having a lifting gearbox, said lifting gearbox including a take-off shaft, said safety brake mechanism being substantially capable of braking the winding drum to a standstill without jerking when a lowering speed of the winding drum is excessive, said safety brake mechanism comprising:

a brake ring that revolves concentrically with the winding drum, said brake ring being frictionally joined to the winding drum when the brake ring engages the winding drum;

said brake ring having a brake surface, said brake surface provided on an outer circumference of said brake ring;

a rigid coupling, said rigid coupling concentrically connecting the take-off shaft of the lifting gearbox with the winding drum, wherein the safety brake mechanism is removably connected with the take-off shaft and the winding drum.

2. The safety brake mechanism as claimed in claim 1, wherein said rigid coupling is at least partially cylindrical in configuration and it is joined at one end via a concentric hub to the take-off shaft of the lifting gearbox and at the other end to the winding drum at its outer circumference adjoining said brake surface.

3. The safety brake mechanism as claimed in claim 2, wherein said hub and the take-off shaft of the lifting gearbox are joined with corresponding rotation drivers.

4. The safety brake mechanism as claimed in claim 3, wherein said rotation driver comprises a key or spline connection.

5. The safety brake mechanism as claimed in claim 4, wherein a region of said hub adjoining said rotation driver includes a centering piece, said centering piece being supported against the take-off shaft of the lifting gearbox.

6. The safety brake mechanism as claimed in claim 5, wherein said coupling encloses the output shaft of the lifting gearbox with a radial spacing and at least said centering piece extends into the winding drum.

7. The safety brake mechanism as claimed in claim 6, wherein said brake ring is positioned at a region of an outer circumference of said coupling that is away from the winding drum and including a locking device secured on the frame piece of the safety brake mechanism, said locking device locking said brake ring.

8. The safety brake mechanism as claimed in claim 7, including recesses facing each other at a circumference of the winding drum and the coupling, and further coupling elements inserted into said recesses in order to join the winding drum to the coupling.

9. The safety brake mechanism as claimed in claim 2, wherein a region of said hub adjoining said rotation driver includes a centering piece, said centering piece being supported against the take-off shaft of the lifting gearbox.

10. The safety brake mechanism as claimed in claim 9, wherein said coupling encloses the output shaft of the lifting gearbox with a radial spacing and at least said centering piece extends into the winding drum.

11. The safety brake mechanism as claimed in claim 1, wherein said brake ring is positioned at a region of an outer circumference of said coupling that is away from the winding drum and including a locking device secured on the frame piece of the safety brake mechanism, said locking device locking said brake ring.

12. The safety brake mechanism as claimed in claim 1, including recesses facing each other at a circumference of the winding drum and the coupling, and further coupling elements inserted into said recesses in order to join the winding drum to the coupling.

13. A method for grinding the brake ring of the safety brake mechanism of claim 1, said method comprising:

testing and adjusting to a required frictional moment of the safety brake mechanism in a jig simulating the take-off shaft of the lifting gearbox prior to the assembly.

14. A hoisting machine, comprising:

a driven winding drum;

a lifting gearbox, said lifting gearbox including a take-off shaft;

a safety brake mechanism, said safety brake mechanism being substantially capable of braking said winding drum to a standstill without jerking when lowering speed of said winding drum is excessive;

said safety brake mechanism comprising a brake ring that revolves concentrically with said winding drum, said brake ring being frictionally joined to said winding drum when said braking ring engages said winding drum;

said brake ring having a brake surface, said brake surface provided on an outer circumference of said brake ring;

a rigid coupling, said rigid coupling concentrically connecting said take-off shaft with said winding drum, wherein said safety brake mechanism is removably connected with said take-off shaft and said winding drum.

15. The hoisting machine as claimed in claim 14, wherein said rigid coupling is at least partially cylindrical in configuration and it is joined at one end via a concentric hub to the take-off shaft of the lifting gearbox and at the other end to the winding drum at its outer circumference adjoining said brake surface.

16. The hoisting machine as claimed in claim 15, wherein said hub and the take-off shaft of the lifting gearbox are joined with corresponding rotation drivers.

17. The hoisting machine as claimed in claim 16, wherein said rotation driver comprises a key or spline connection.

18. The hoisting machine as claimed in claim 14, wherein a region of said hub adjoining said rotation driver includes a centering piece, said centering piece being supported against the take-off shaft of the lifting gearbox.

19. The hoisting machine as claimed in claim 18, wherein said coupling encloses the output shaft of the lifting gearbox with a radial spacing and at least said centering piece extends into the winding drum.

20. The hoisting machine as claimed in claim 15, wherein said brake ring is positioned at a region of an outer circumference of said coupling that is away from the winding drum and including a locking device secured on the frame piece of the safety brake mechanism, said locking device locking said brake ring.

21. The hoisting machine as claimed in claim 14, including recesses facing each other at a circumference of the winding drum and the coupling, and further coupling elements inserted into said recesses in order to join the winding drum to the coupling.

* * * * *